US005772247A

United States Patent [19]

Legrand

[11] Patent Number: 5,772,247

[45] Date of Patent: Jun. 30, 1998

[54] ART KIT IN BOOK FORM

[75] Inventor: Christian Legrand, Nonthaburi, Thailand

[73] Assignee: International Book Marketing Ltd., Princeton, N.J.

[21] Appl. No.: 635,178

[22] Filed: Apr. 25, 1996

[51] Int. Cl.[6] ..... B42D 3/18

[52] U.S. Cl. ..... 281/31; 281/51; 281/29; 281/38; 283/117; 206/575; 206/579; 434/81; 434/84

[58] Field of Search ..... 402/79, 4, 35; D19/35; 281/2, 5, 38, 31, 51, 15.1, 29; 434/81, 84, 98, 103; 283/117; 206/1.7, 1.9, 575

[56] References Cited

U.S. PATENT DOCUMENTS

| | | | |
|---|---|---|---|
| D. 334,592 | 4/1993 | Nghi | D19/27 |
| 403,785 | 5/1889 | Southworth | 281/31 |
| 703,500 | 7/1902 | Sullivan | 434/84 |
| 802,031 | 10/1905 | Eschenbach . | |
| 841,360 | 1/1907 | Tuck | 281/31 |
| 870,771 | 11/1907 | Garman | 206/1.7 |
| 1,175,225 | 3/1916 | Bleecker | 446/70 R |
| 1,193,181 | 8/1916 | Peck | 281/31 |
| 1,205,779 | 11/1916 | Peck . | |
| 1,221,118 | 4/1917 | Ward . | |
| 1,224,363 | 12/1917 | Crump . | |
| 1,316,309 | 9/1919 | Knaster | 206/1.9 |
| 2,258,418 | 10/1941 | Macey | 281/15.1 X |
| 2,319,044 | 5/1943 | DiLemme | 35/26 |
| 3,093,462 | 6/1963 | Rapaport | 41/26 |
| 3,315,374 | 4/1967 | Geraty | 35/26 |
| 3,447,256 | 6/1969 | Compton | 464/1 |
| 3,529,832 | 9/1970 | Goetz et al. | 434/317 |
| 3,605,287 | 9/1971 | Jonesi | 35/26 |
| 3,747,232 | 7/1973 | Donaldson et al. | 35/26 |
| 3,819,436 | 6/1974 | Allen | 156/63 |
| 3,869,824 | 3/1975 | Lemelson | 46/17 |
| 4,169,323 | 10/1979 | Engel | 35/26 |
| 4,540,375 | 9/1985 | Fogarty et al. | 446/146 |
| 4,584,042 | 4/1986 | Wandroik | 156/280 |
| 5,190,317 | 3/1993 | Zoland | 281/31 |
| 5,209,665 | 5/1993 | Billings et al. | 446/397 X |
| 5,213,504 | 5/1993 | Lee et al. | 434/84 |
| 5,234,344 | 8/1993 | Lenkoff | 434/84 |
| 5,292,255 | 3/1994 | Goldwasser | 434/84 |
| 5,351,992 | 10/1994 | Chilson et al. | 281/31 |

FOREIGN PATENT DOCUMENTS

| | | | |
|---|---|---|---|
| 281185 | 1/1965 | Australia . | |
| 757424 | 12/1993 | France | 434/81 |
| 920896 | 12/1954 | Germany | 281/29 |
| 12597 | of 1893 | United Kingdom . | |

OTHER PUBLICATIONS

A photograph of an Alex® Colorful Sand Refill Pack For Alex™ Sand Kits And Craft Activities.

A photograph of an Alex® Sand Party Pre–Cut Patterns For Use With Alex™ Sand.

Photographs of "Livre Activités Sables Magiques" (Magic Sand Activity Books), copyright 1989.

*Primary Examiner*—Andrea L. Pitts
*Assistant Examiner*—G. Andoll
*Attorney, Agent, or Firm*—Seidel Gonda Lavorgna & Monaco, PC

[57] ABSTRACT

A kit for creating artwork such as sand painting is provided having a front cover, a back cover, and an interposed spine. The spine spaces the front and back cover when folded into a book form. The back cover extends outwardly beyond the front cover when folded and has a container mounted thereon which retains a series of dispensers therein. A booklet is mounted to the inside of one of the covers and an envelope is mounted to the inside of the other cover. A plurality of drawing sheets are provided having a base and a cover sheet. The base has a layer of pressure sensitive adhesive which is removably covered by the cover sheet. The cover sheet has perforations to define a plurality of removable portions. Each dispenser has a plurality of small color particles of a pre-selected color. To create a sand painting, a drawing sheet is selected; a portion of the cover sheet is removed from the drawing sheet, exposing the layer of pressure sensitive adhesive; a dispenser of a pre-selected color is selected; and the color particles are sprinkled from the dispenser onto the exposed pressure sensitive adhesive. The process is repeated until the sand painting is completed.

13 Claims, 7 Drawing Sheets

ART KIT IN BOOK FORM

FIELD OF THE INVENTION

The present invention relates to a kit for creating artwork which is in the form of a book and more particularly to a kit having the components to create what is known as sand paintings.

BACKGROUND OF THE INVENTION

Sand painting may be created by a base such as a rectangular piece of cardboard, which is provided on one surface with a coating or layer of pressure-sensitive adhesive. A removable cover sheet is placed over the adhesive layer to prevent premature adhesion to the adhesive. Colored granular material is sprinkled onto the adhesive in a selective pattern to create a picture.

The cover sheet may be pre-cut or perforated to provide a number of individual removable sections. Individual sections of the cover can be removed;, therefore, only exposing specific sections of the base at a time. U.S. Pat. No. 3,315,374 discloses such a method of making a picture.

It is desired to have a kit which is compact and stylish and which conveniently contains a plurality of drawing sheets, and colored granular material dispensers, and allows easy access and storage of the components.

SUMMARY OF THE INVENTION

The present invention resides in a kit for creating artwork. Preferably the kit is adapted to be used for creating sand paintings.

The kit of the present invention is in book form having a front over, a back cover, and an interposed spine. The back cover extends outward beyond the front cover when the book is closed. A container is mounted on the portion of the back cover which extends beyond the front cover. The container receives a plurality of dispensers. The dispensers preferably include a colored particulate material, with each dispenser having a different color therein. A booklet is mounted inside of the front and back covers. An envelope is also mounted inside the covers to receive and retain a plurality of articles, such as drawing sheets. The drawing sheets have a base and a cover sheet. The base has on one surface a coating or layer of pressure sensitive adhesive. The cover sheet is removable and has perforations or pre-cuts to define a plurality of removable sections.

To create a sand painting, a drawing sheet is selected. One section of the cover sheet is removed from the base, exposing the pressure sensitive adhesive. A dispenser having the colored sand therein is selected from the container. The colored sand particles are sprinkled from the dispenser onto the exposed adhesive. The process is repeated until the sand painting is completed.

Further objects, features, and advantages of the present invention will become apparent to those skilled in the art upon reviewing and comprehending the embodiment described below and as illustrated in the accompanying drawings.

BRIEF DESCRIPTION OF THE DRAWINGS

For the purpose of illustrating the invention, the drawings show a form which is presently preferred. However, the invention is not intended to be limited, nor is it limited, to the precise arrangement and instrumentalities shown.

DETAILED DESCRIPTION OF THE INVENTION

Figure 1:
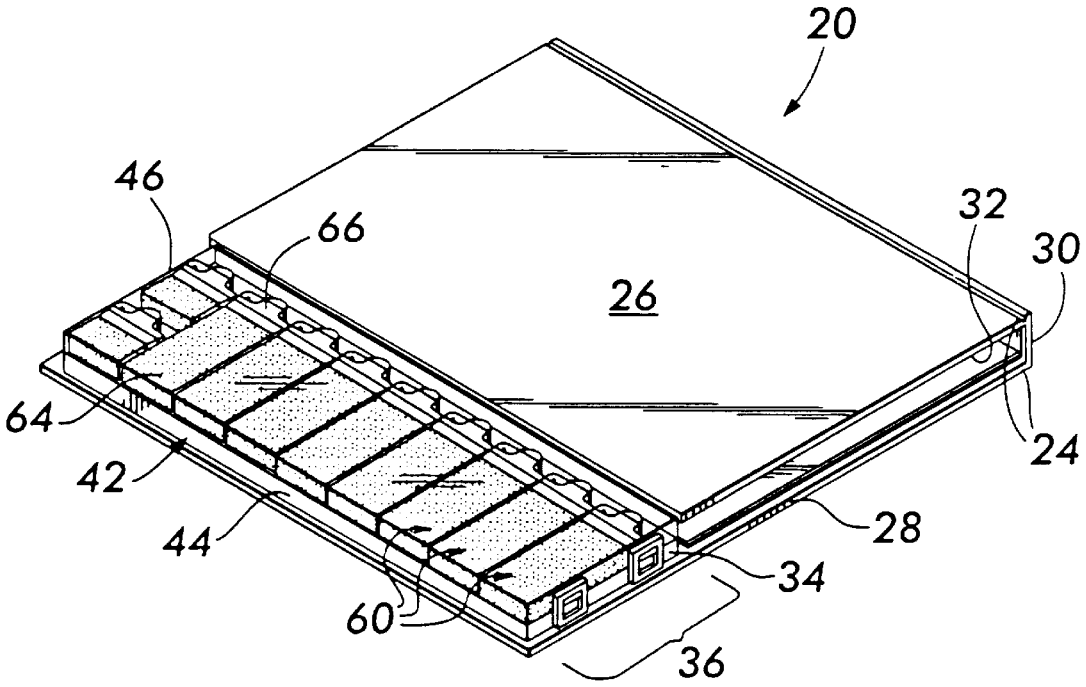
FIG. 1 is perspective view of a kit in accordance with the present invention.

In the drawings, where like numerals indicate like elements, there is shown a kit 20 according to the present invention. Referring to FIG. 1, the kit 20 includes a front cover 26, a rear cover 28, a spine 30 and a pair of parallel folds 24 connecting the front and rear covers to the spine. The spine 30 spaces the front cover 26 and back cover 28 when folded in the closed position and creates a book-like form, wherein the insides 32 and 34 of the front cover 26 and the back cover 28, respectively, face each other. The back cover 28 extends farther from the spine 30 than the front cover 26, creating an extended portion 36.

The covers 26, 28 and spine 30 may be made of three individual pieces of cardboard. A paper wrapping having a finish and/or a design on the outside is adhered to the cardboard, and wrapped around to the inside. The paper located between the cardboard may define folds 24.

The kit 20 has a container 42, or box, mounted to the inside 34 of the back cover 28 on the portion 36 which extends beyond the front cover 26. The container 42 has a base portion 44 and a top cover 46. In a preferred embodiment, the top cover 46 is transparent. A plurality of dispensers 60 are retained within the container 42. Each dispenser 60 has a receptacle 64 and a cover or cap portion 66. The receptacle 64 is preferably transparent to allow the contents therein to be seen. The cover 66 is also preferably color-coordinated with the contents of the dispenser 60. The dispensers 60 preferably include a colored granular material or particles. While sometimes referred to as sand, the particles in a preferred embodiment are a plastic based material.

Figure 2:
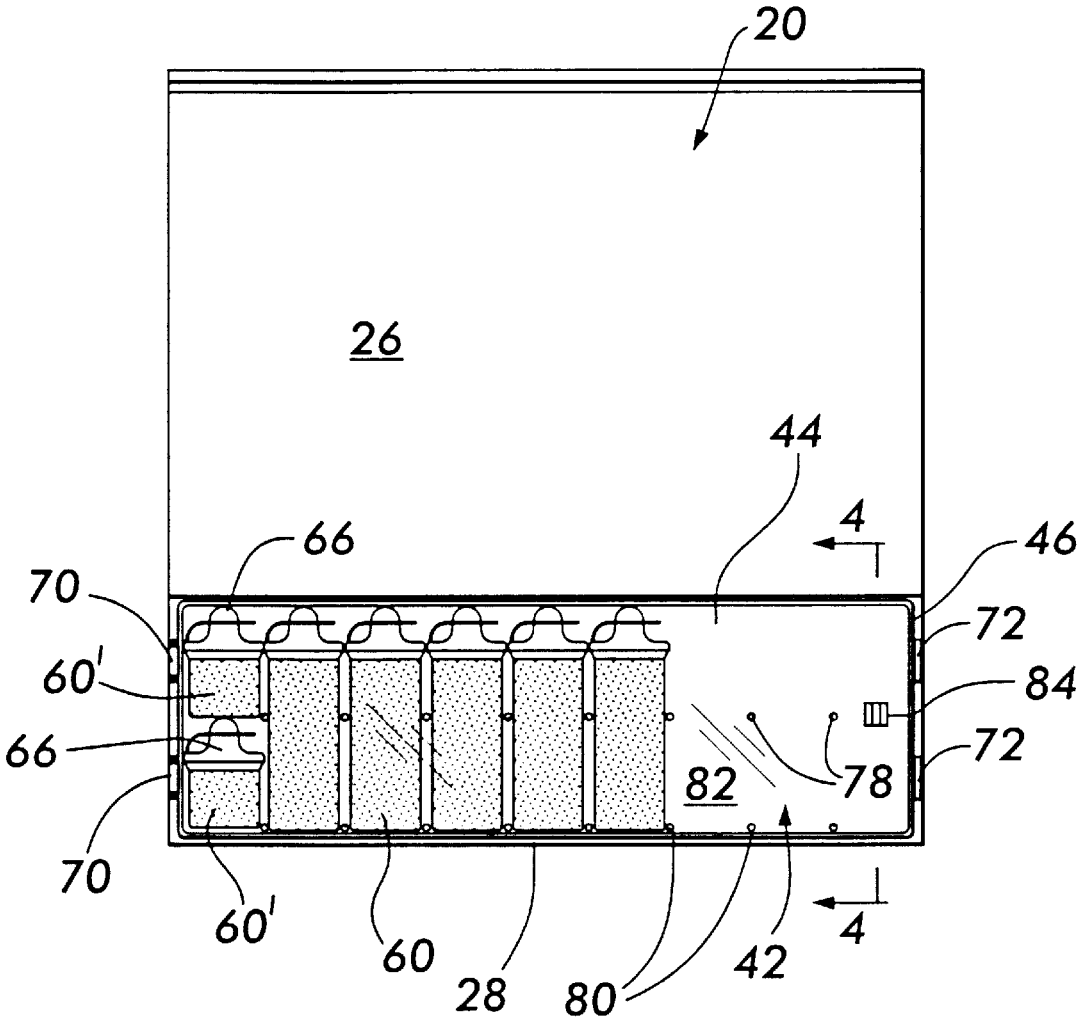
FIG. 2 is a top plan view of the kit shown in FIG. 1 with several dispensers removed from the container.
Figure 6:
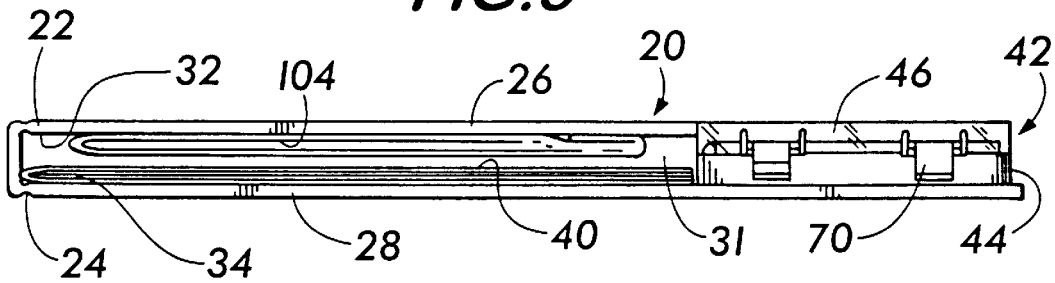
FIG. 6 is a left side elevational view of the kit of the present invention.
Figure 7:
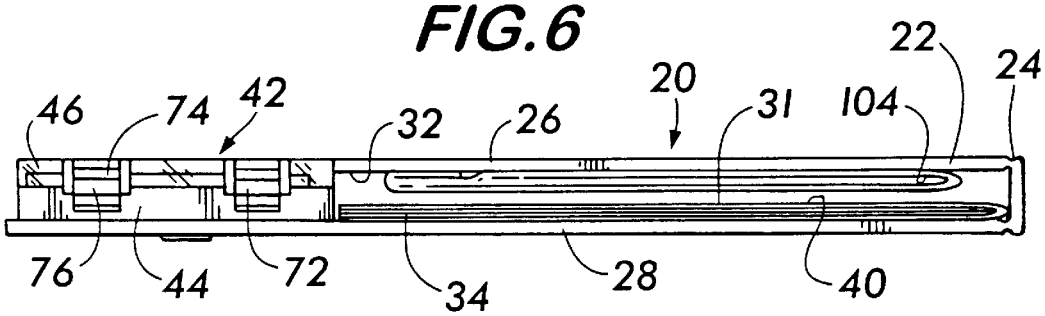
FIG. 7 is a right side elevational view of the kit of the present invention.

Referring to FIG. 2, the container 42 is shown in a closed secured position. The top cover portion 46 is hingedly mounted to the base portion 44 by a pair of hinges 70 on one end of the container 42. The structure of the hinges is more clearly shown in FIGS. 5 and 6. A pair of latches 72 is formed at the opposite end of the container 42. The structure of the latches is more clearly shown in FIG. 7. Latches 72 each have a tab 74 projecting from the side wall of the top cover 46 and a hasp 76 which extends upwardly from the side wall of the base portion 44. The hasp 76 fits over the tab 74 and secures same in a press-fit or snapping relationship.

The container 42 has a plurality of pins 78 projecting upwardly from the bottom of the base portion 44. The pins 78 define dispenser receiving spaces 82. In addition, a plurality of pins or tabs 80 project outwardly from the side wall of the base portion 44 to further define the dispenser receiving spaces 82. A dispenser 60 removed from the container 42 can be easily return to its proper dispenser receiving space 82 defined by the pins 78, 80.

As illustrated, the dispensers may vary in size. Two half height dispensers 60' are shown as fitting into one dispenser receiving space 82. The half height dispensers 60' are used for holding particles whose quantity is not in as much demand. It is recognized that other height ratios for the dispensers could be used, such as being one third the height and two thirds the normal height of dispenser 60. Each smaller dispenser 60', as illustrated, includes a standard cap 66.

Figure 3:
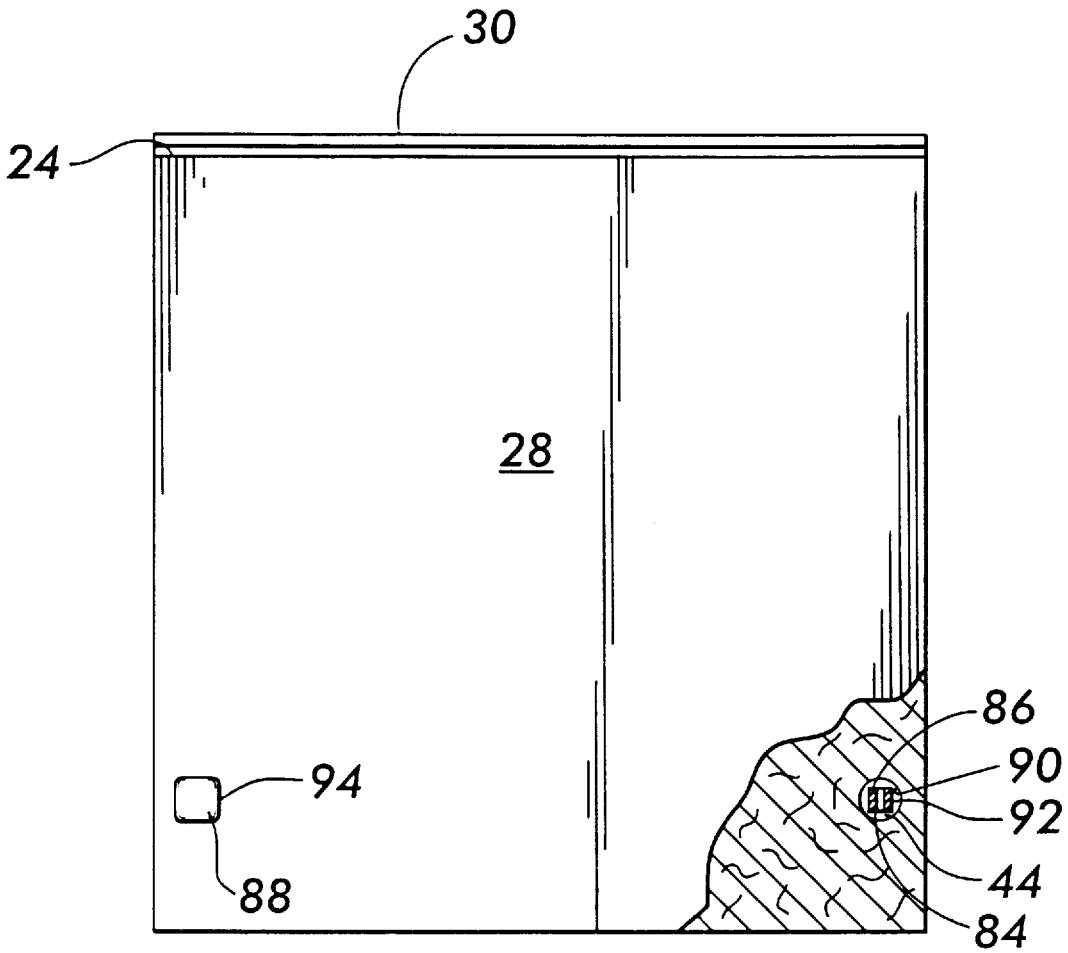
FIG. 3 is a bottom plan view of the kit with a portion of the back cover broken away.
Figure 4:
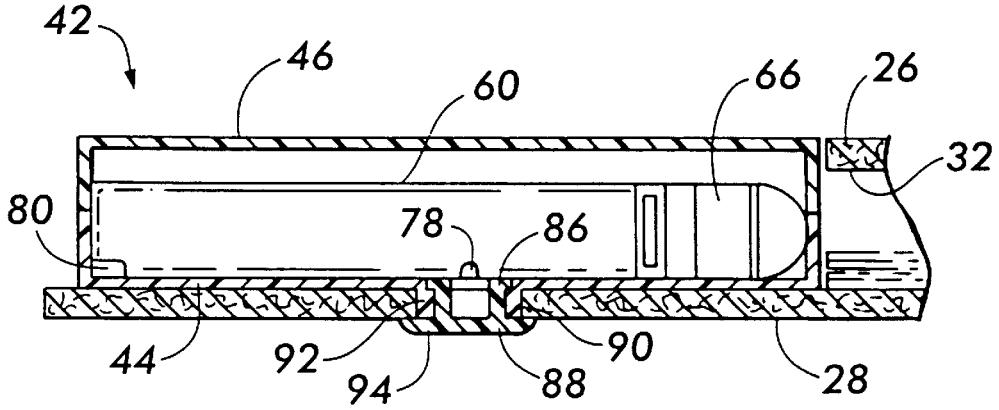
FIG. 4 is a sectional view of the kit taken along line 4—4 in FIG. 2.
Figure 5:
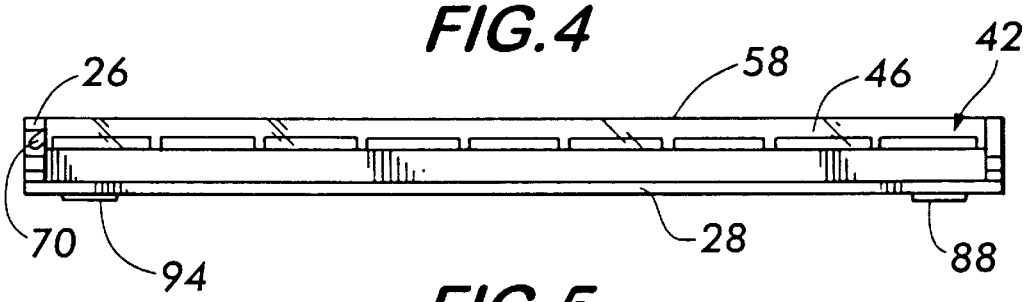
FIG. 5 is front elevational view of the kit of the present invention.

Referring to FIGS. 2–4, the bottom floor of the base portion 44 of the container 42 has a pair of rectangular openings 84 therein (only one seen). Each rectangular opening 84 receives a pair of locking legs 86 from a locking tab 88. The locking tabs 88 secure the container 42 to the back cover 28. Referring particularly to FIG. 3, the back cover 28 has a pair of openings 90 therein (only one seen), located at the same positions as the openings 84 in the base 44 of container 42. As shown in FIG. 4, the base portion 44 has projections 92 (only one shown) which extend into the opening 90 in the rear cover 28. The locking tabs 88 have a base 94 from which the locking legs 86 project. The container 42 is positioned on the rear cover 28 with the projections 92 inserted within openings 90. The legs 86 of tabs 88 project through openings 84 in base 44 to clamp the container 42 to the cover 28. As shown in FIG. 5, the base 94 of tabs 88 project below the rear cover 28 to form feet.

Figure 8:
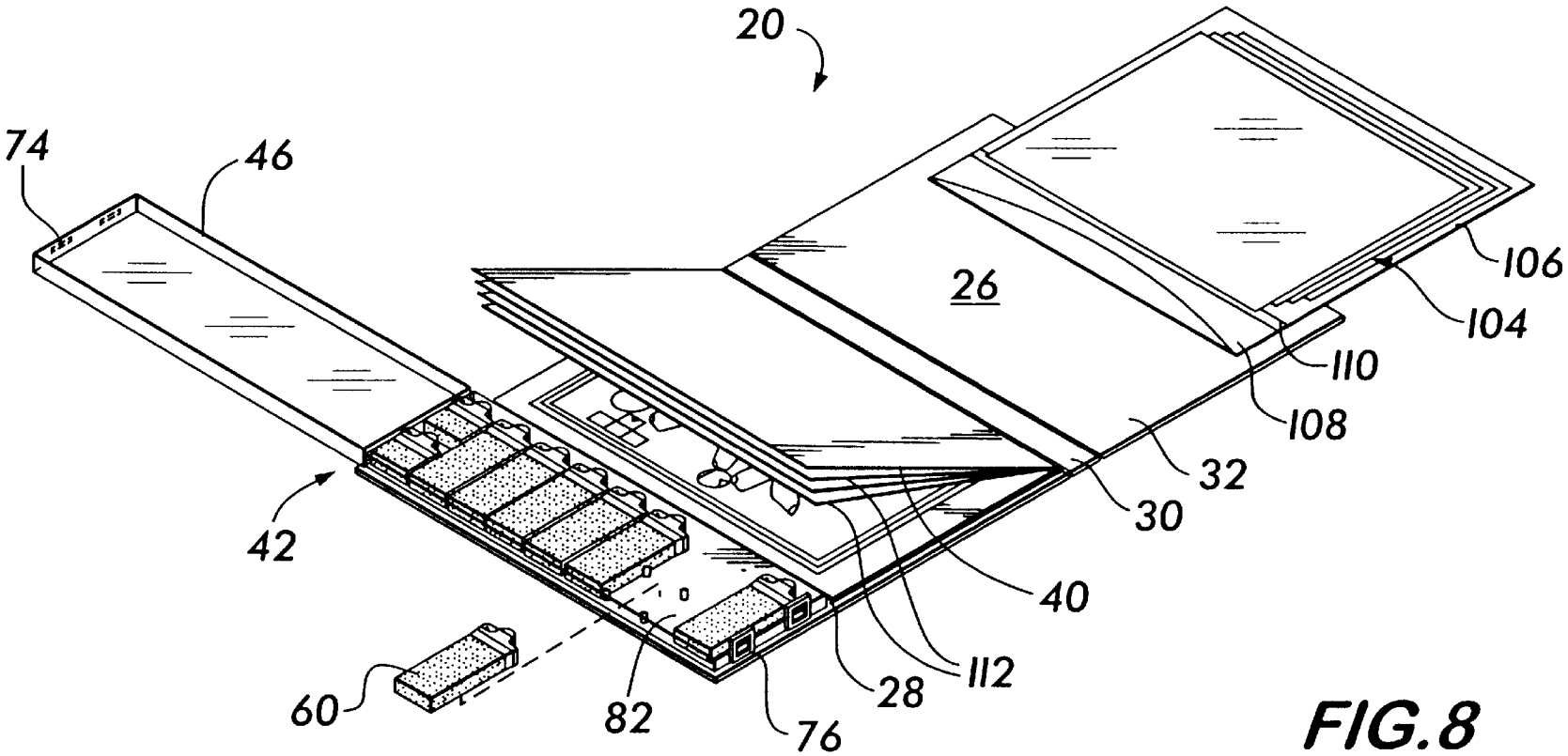
FIG. 8 is a perspective view of the kit of the present invention shown in an open position.

In FIG. 8, the kit 20 is shown in the open condition. Front cover 26 is flipped opened, exposing an envelop 104 and a booklet 40. Also, the top cover 46 of container 42 is shown in the opened condition, exposing the dispensers 60 for removal from the receptacles 82 in the bottom portion 44.

Envelope 104 has a main pocket portion 106 and a flap 108. The flap 108 is secured to the inside surface 32 of the front cover 26 and is connected to the main pocket portion 106 at fold 110. The main pocket portion 106 as shown is flipped up from its storage position. This open position for the envelope 104 provides access to the contents of the pocket 106. It is preferred that the envelope 104 be mounted on the front cover 26 such that removal of the contents from the pocket 106 does not interfere with the container 42 or the booklet 40.

The booklet 40 has a plurality of pages 112. The booklet 40 may include a series of instructions or examples. The examples may be secured within the page by a series of perforations such that they can be detached, leaving a frame. The frame pages may also be removed from the booklet 40 and used with the artwork to be created. Other functions for the booklet 40 are also contemplated.

Figure 9:
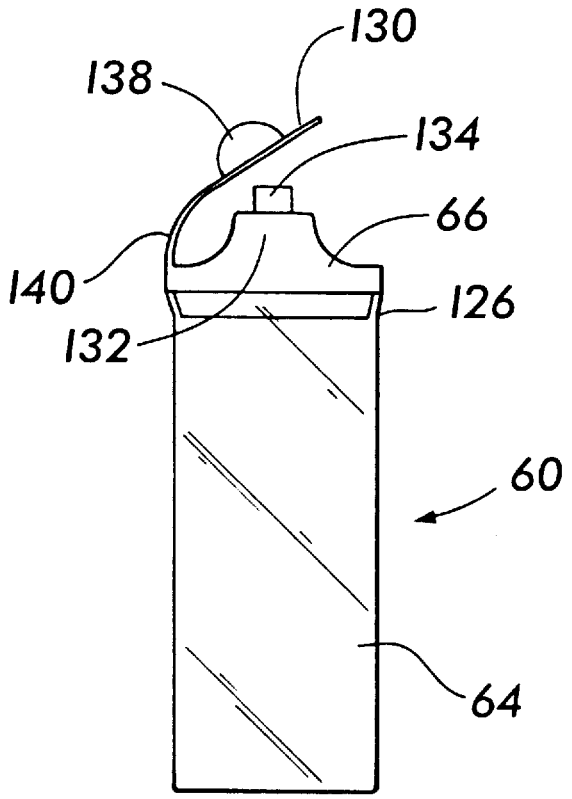
FIG. 9 is a front view of a dispenser within the kit.
Figure 10:
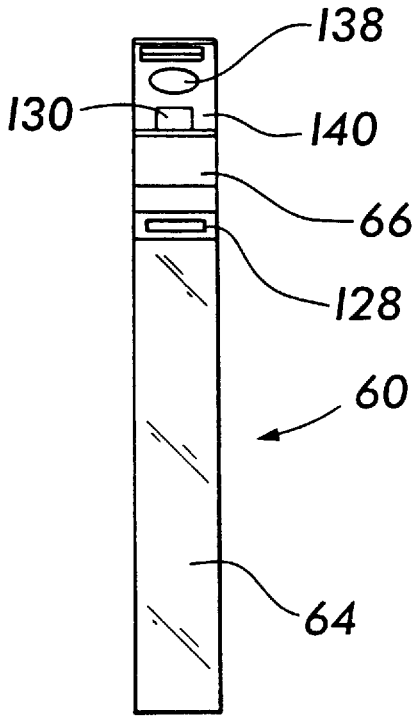
FIG. 10 is a side view of the dispenser.

Referring to FIGS. 9 and 10, the dispenser 60 is shown as including the receptacle 64 and cap 66. The receptacle 64 has a ledge 126 and a pair of slots 128 to secure the cap 66 thereto. The cap 66 has a removable top 130 and a base portion 132. The base portion 132 has a dispensing nozzle 134 having a opening, not shown, through which the particles can pass. The top 130 has a dome portion 138 for closing the dispensing nozzle 134. The dome 138 is attached to the base portion 132 by strap 140 for hingedly mounting the dome 138.

Figure 11:
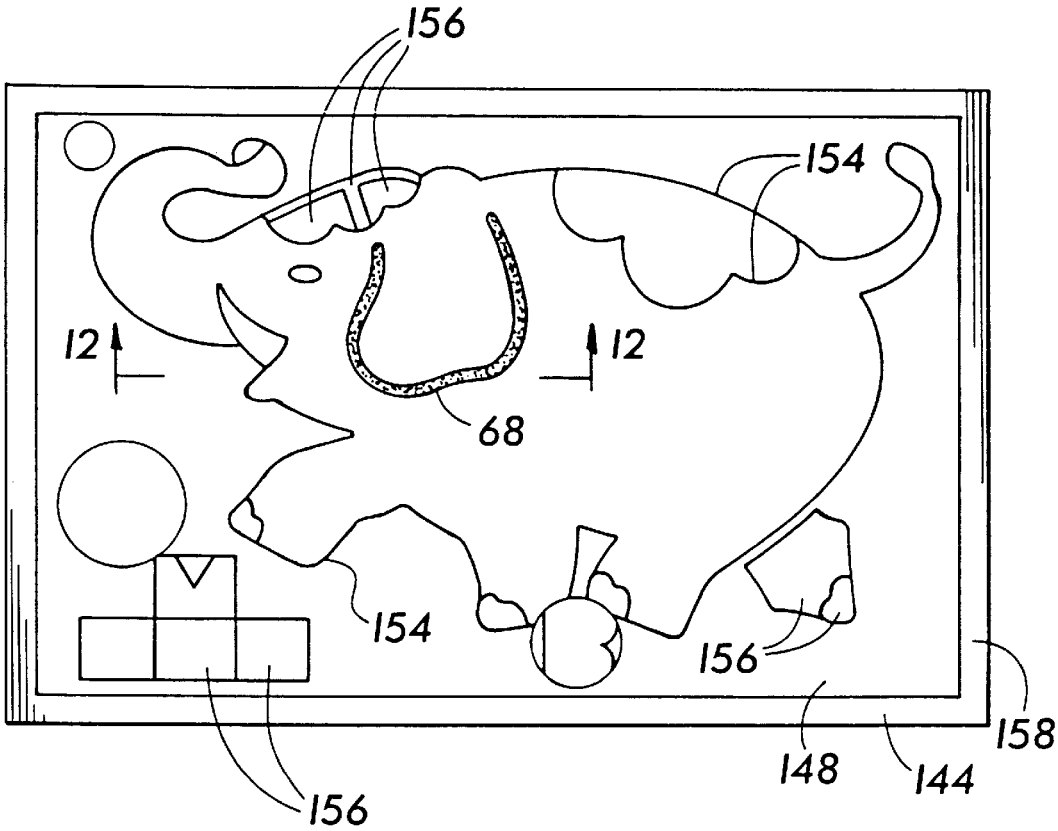
FIG. 11 is top view of one of the drawing sheets within the invention.
Figure 12:
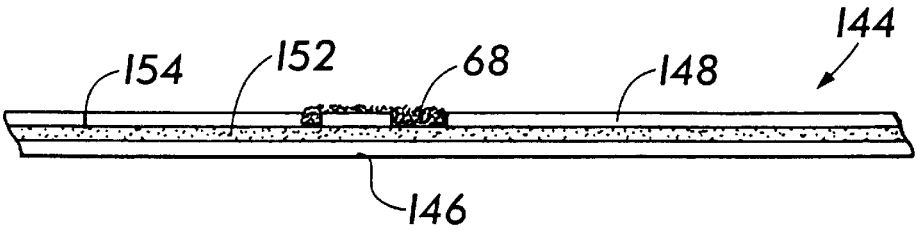
FIG. 12 is a sectional view taken along the line 12—12 in FIG. 11.

The envelope 104 preferably retains a series of drawing sheets 144 of the type shown in FIGS. 11 and 12. Each drawing sheet 144 has a base 146 and a cover 148. The base 146 has on one surface a layer of a pressure sensitive adhesive 152. The cover sheet 148 has perforations or predefined cuts 154 to define a plurality of removable portions 156. The perforations 154 are formed in a set pattern such as an elephant in a circus scene (as shown). Any pattern, however, may be defined as desired. The envelope 104 may also include a separate envelope for mailing the drawing sheets 144 after completion.

In order to create a "sand painting", the top cover 26 of the kit 20 is unfolded from the closed position to expose the envelope 104 and booklet 40. The envelope 104 is unfolded to allow access to the contents of the pouch 106 and removal of one of the drawings sheets 144. The user may also review the instructions or find an example in the booklet 40, if desired. The latches 72 on the side of the container 42 are undone and the top cover portion 46 is swung to the open position to allow access to the dispensers 60 containing the sand particles. One portion 156 of the cover sheet 148 is removed from the drawing sheet 144, exposing the adhesive 152. A dispenser 60 having the desired color is selected. The dome 138 is removed from the nozzle 134. The particles 68 are sprinkled onto the uncovered layer of adhesive 152. (See FIGS. 11 and 12.) The cap 130 is placed back on the nozzle 134 and the dispenser 60 is returned to the receptacle 84. The particles can be rubbed into the adhesive 152 to improve engagement. Excess particles may be removed by holding the drawing vertical and tapping the drawing sheet 144. These steps are repeated until the artwork is complete.

The drawing sheet 144 has an outer boarder 158 defined by the which can be removed to expose pressure sensitive adhesive. The outer boarder 158 can be secured to a frame to create a framed picture. Also, a mailing envelope can be used to mail the finished drawing sheet to a loved one.

The present invention may be embodied in other specific forms without departing from the spirit or essential attributes thereof and, accordingly, reference should be made to the appended claims, rather than to the foregoing specification, as indicating in the scope of the invention.

I claim:

1. A kit for creating artwork comprising:

a front cover, a back cover, and an interposed spine, the front and back pivotably secured to the spine so as to be foldable into a book form, the back cover extending farther from the spine than the front cover, a booklet mounted to the inside of one of the covers, the booklet having a series of pages, a container mounted to the portion of the back cover extending farther from the spine than the front cover, and a plurality of removable color creating dispensers positioned within the container.

2. A kit as claimed in claim 1 wherein the container has a base portion and a top cover portion, the top cover portion hingedly secured to the base at one end.

3. A kit as claimed in claim 2 wherein the top cover of the container is transparent to show the dispensers therein.

4. A kit as claimed in claim 1 wherein the dispensers have a transparent portion for showing their contents, and a cover portion which is color-coordinated with the contents.

5. A kit as claimed in claim 4 wherein the cover of the dispenser has a removable cap.

6. A kit as claimed in claim 2 wherein the bottom portion of the container has a series of dispenser receiving areas.

7. A kit for creating artwork comprising:

a front cover, a back cover, and an interposed spine, the spine spacing the a front and back covers when folded into a book form, the back cover extending farther from the spine than the front cover and outward beyond the front cover when folded into the book form, a booklet mounted to the inside of one of the covers, the booklet having a series of pages;

an envelope mounted to the inside of one of the covers and adapted to receive a plurality of articles;

a container mounted to the portion of the inside of the back cover extending farther from the spine than the front cover; and a plurality of dispensers received in the container, the dispenser retaining a colorized particulate material.

8. A kit as claimed in claim 7 wherein the articles adapted to be received in the envelope comprise a plurality of drawing sheets, the drawing sheets having a base and a cover sheet, the base having on one surface a layer of a pressure sensitive adhesive, the cover sheet having perforations or pre-cuts to define a plurality of removable portions.

9. A kit as claimed in claim 8 wherein the dispensers have a transparent portion for showing the colored material therein and a cover portion which is color-coordinated with the colored particulate.

10. A kit as claimed in claim 9 wherein the cover of the dispenser comprises a dispensing nozzle and a removable cap for accessing the dispensing nozzle, the removable cap hingedly mounted to the cover.

11. A kit as claimed in claim 10 wherein the top cover of the container is transparent to show the dispensers located in the container.

12. A kit as claimed in claim 11 further comprising a pair of relatively smaller dispensers which are in a range of one third to two thirds the height of the other dispensers.

13. A kit for creating sand painting artwork, comprising:

a front cover, a back cover, and an interposed spine, the front and back covers connected to the spine by foldable sections, the front and back cover pivotable about the foldable sections so as to move between an open and closed condition, the back cover, when in the closed condition, extending farther from the spine than the front cover and defining an extended portion, a booklet mounted to one of the covers, the booklet having a series of pages therein, the booklet being enclosed by the covers when in the closed condition, a container mounted to the extended portion of the back cover, the container having a base portion and a transparent cover portion, the transparent cover portion being pivotably attached to the base portion so as to create an open and closed condition for the container, a plurality of removable color-creating dispensers positioned within the container, each dispenser including a colored particulate material which may be dispensed from the dispenser by removal of a cap secured to the dispenser, the dispenser having a substantially transparent portion for viewing of the colored particulate material therein, an envelope secured to at least one of the covers, the envelope having a flap attached to the cover, and a plurality of drawing sheets retained within the envelope, the drawing sheets including a base portion and a cover sheet portion, the cover sheet portion having a series of perforations therein to define a plurality of separately removable sections, the base portion having a pressure sensitive adhesive thereon, the cover sheet portion being removable from the adhesive to expose the adhesive such that the particulate material may be dispensed thereon and attached thereto, creating artwork.

* * * * *